US011370134B2

(12) United States Patent
Phoon

(10) Patent No.: US 11,370,134 B2
(45) Date of Patent: Jun. 28, 2022

(54) STATIONARY BLADE, BLADE SET, AND MANUFACTURING METHOD

(71) Applicant: KONINKLIJKE PHILIPS N.V., Eindhoven (NL)

(72) Inventor: Kin Fatt Phoon, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 26 days.

(21) Appl. No.: 16/603,598

(22) PCT Filed: Apr. 9, 2018

(86) PCT No.: PCT/EP2018/058993

§ 371 (c)(1),
(2) Date: Oct. 8, 2019

(87) PCT Pub. No.: WO2018/189085

PCT Pub. Date: Oct. 18, 2018

(65) Prior Publication Data

US 2020/0130207 A1 Apr. 30, 2020

(30) Foreign Application Priority Data

Apr. 11, 2017 (EP) ..... 17165869

(51) Int. Cl.
*B26B 19/38* (2006.01)
*B26B 19/04* (2006.01)
*B26B 19/06* (2006.01)

(52) U.S. Cl.
CPC ..... *B26B 19/3846* (2013.01); *B26B 19/042* (2013.01); *B26B 19/06* (2013.01); *B26B 19/3893* (2013.01)

(58) Field of Classification Search
CPC ... B26B 19/3846; B26B 19/042; B26B 19/06; B26B 19/3893
(Continued)

(56) References Cited

U.S. PATENT DOCUMENTS 2,102,529 A * 12/1937 Hanley ..... B26B 19/042 30/43.92
2,151,965 A 3/1939 Hanley
(Continued)

FOREIGN PATENT DOCUMENTS

GB 594785 11/1947
WO 2013/150412 10/2013
(Continued)

OTHER PUBLICATIONS

International Search Report and Written Opinion dated Jul. 11, 2018 for International Application No. PCT/EP2018/058993 filed Apr. 9, 2018.

*Primary Examiner* — Evan H MacFarlane
*Assistant Examiner* — Liang Dong

(57) ABSTRACT

A stationary blade for a blade set of a hair cutting appliance includes a top wall, a bottom wall, and a guide slot formed between the top and bottom walls to accommodate a movable blade. The stationary blade further includes a plurality of stationary blade teeth each having a frontal end. The top and bottom walls are mutually joined at the frontal ends, where the top and bottom walls are, at least at the frontal ends, made from sheet metal material. Further, at the frontal ends, two or more sheet metal folded edges are present.

16 Claims, 13 Drawing Sheets

(58) Field of Classification Search
USPC ..... 30/43.92
See application file for complete search history.

(56) References Cited

U.S. PATENT DOCUMENTS

| | | | | | |
|---|---|---|---|---|---|
| 2,234,891 | A | * | 3/1941 | Bruecker | B26B 19/12 30/34.1 |
| 2,273,739 | A | | 2/1942 | Te Pas | |
| 2,325,205 | A | * | 7/1943 | Molnar | B21D 53/00 72/339 |
| 2,534,861 | A | | 12/1950 | Anestis | |
| 2,550,056 | A | | 4/1951 | Anestis | |
| 3,107,423 | A | * | 10/1963 | Caesar | B26B 19/20 30/537 |
| 3,178,815 | A | * | 4/1965 | Madrid | B26B 19/3813 30/286 |

FOREIGN PATENT DOCUMENTS

| | | |
|---|---|---|
| WO | 2015/158571 | 10/2015 |
| WO | 2015/158923 | 10/2015 |
| WO | 2016/001019 | 1/2016 |
| WO | 2016/042158 | 3/2016 |
| WO | 2016/134979 | 9/2016 |
| WO | 2016/184874 | 11/2016 |

* cited by examiner

STATIONARY BLADE, BLADE SET, AND MANUFACTURING METHOD

CROSS REFERENCE TO RELATED APPLICATIONS

This application is the U.S. National Phase application under 35 U.S.C. § 371 of International Application No. PCT/EP2018/058993 filed Apr. 9, 2018, published as WO 2018/189085 on Oct. 18, 2018, which claims the benefit of European Patent Application Number 17165869.3 filed Apr. 11, 2017. These applications are hereby incorporated by reference herein.

FIELD OF THE INVENTION

The present disclosure relates to a stationary blade for a blade set of a hair cutting appliance, the stationary blade comprising a top wall, a bottom wall, and a guide slot formed therebetween to accommodate a movable blade, a plurality of stationary blade teeth each having a frontal end, wherein the top wall and the bottom wall are mutually joined at the frontal ends. The present disclosure also relates to a blade set for a hair cutting appliance, and to a hair cutting appliance. The present disclosure further relates to a method of manufacturing a stationary blade for a blade set of a hair cutting appliance, and to a corresponding blade set manufacturing method.

BACKGROUND OF THE INVENTION

WO 2013/150412 A1 discloses a stationary blade for a blade set of an electrically operated hair cutting appliance, the blade including a first wall and a second wall, each wall defining a first surface, a second surface facing away from the first surface, and a laterally extending leading edge defining a plurality of laterally spaced apart longitudinally extending projections, wherein the first surfaces of the first and second walls face each other, at least at their leading edges, while facing projections along the leading edges of the first and second walls are mutually connected at their tips to define a plurality of generally U-shaped teeth, and the first surfaces of the first and second walls define a laterally extending guide slot for a movable blade of said blade set between them, wherein the projections of the first wall have an average thickness that is less than an average thickness of the projections of the second wall.

Manufacturing approaches to double walled stationary blades are disclosed in WO 2016/001019 A1 and WO 2016/042158 A1 that describe arrangements wherein at least the top wall of the stationary blade is at least substantially made from sheet metal material.

U.S. Pat. No. 2,273,739 A discloses a corrugated face plate, made from sheet metal, for a shaving device, the face plate having a plurality of series of cutter bars adapted for simultaneous contact with the skin, wherein cutter bars of the innermost series are in the form of comb teeth supported at their opposite ends, and wherein the cutter bars in the outer series are projecting away from the central portion of said face plate in the form of outwardly projecting pointed comb teeth. U.S. Pat. No. 2,151,965 A shows a similar arrangement of a hair clipper, wherein lateral clip members are provided that retain lateral ends of a sheet metal stationary blade.

Cutting appliances are well known in the art. Cutting appliances may particularly involve hair cutting appliances. In a more general context, the present disclosure addresses personal care appliances, particularly grooming appliances. Grooming appliances involve, but are not limited to, hair cutting appliances, particularly trimming appliances, shaving appliances, and combined (dual-purpose or multi-purpose) appliances.

Hair cutting appliances are used for cutting human hair, and occasionally animal hair. Hair cutting appliances may be used for cutting facial hair, particularly for shaving and/or for beard trimming. Further, cutting appliances are used for cutting (involving shaving and trimming) head hair and body hair.

In the trimming mode, the hair cutting appliance is typically equipped with a so-called spacing comb that is arranged to space away the blade set of the hair cutting appliance from the skin. Depending on the effective (offset) length of the spacing comb, a remaining hair length after the trimming operation may be defined.

Hair cutting appliances in the context of the present disclosure typically comprise a cutting head which may be referred to as processing head. At the cutting head, a blade set is provided, the blade set comprising a so-called stationary blade and a so-called movable blade. When the hair cutting appliance is operated, the movable blade is moved with respect to the stationary blade which may involve that respective cutting edges cooperate with one another to cut hair.

Hence, in the context of the present disclosure a stationary blade is arranged to be attached to the hair cutting appliance in such a way that a drive unit thereof is not cooperating with the stationary blade. Rather, the drive unit is typically coupled with the movable blade and arranged to set the movable blade into motion with respect to the stationary blade. Hence, the stationary blade may be, in some embodiments, fixedly attached to a housing of the hair cutting appliance.

However, in alternative embodiments, the stationary blade is arranged at the housing of the hair cutting appliance in a pivotable fashion. This may for instance enable a contour-following feature of the cutting head of the hair cutting appliance. Therefore, the term stationary blade, as used herein, shall not be interpreted in a limiting sense. Further, needless to say, when the hair cutting appliance as such is moved, also the stationary blade is moved. However, the stationary blade is not arranged to be actively actuated to cause a cutting action. Rather, the movable blade is arranged to be moved with respect to the stationary blade.

The stationary blade may also be referred to as guard blade. Typically, when the hair cutting appliance is operated to cut hair, the stationary blade is, at least in part, arranged between the movable blade and the hair or skin of the user. As used herein, the term user shall refer to a person or subject whose hair is being processed or cut. In other words, the user and the operator of the hair cutting appliance are not necessarily one and the same person. The term user may also involve a client at a hairdresser or barber shop.

In some aspects, the present disclosure relates to hair cutting appliances that are capable of both trimming and shaving operations. In this context, hair cutting appliances are known that incorporate a dual cutting arrangement including a first blade set that is suitably configured for trimming and a second blade set that is suitably configured for shaving. For instance, the shaving blade set may include a perforated foil that cooperates with a movable cutting element. Rather, the trimming blade set may include two blades that are respectively provided with teeth that cooperate with one another. In principle, the perforated foil that forms the stationary part of the shaving blade set may be much thinner than the stationary blade of a trimming blade set which, primarily for strength reasons, must be considerably thicker in conventional appliances.

The above WO 2013/150412 A1 proposes to provide the stationary blade with two walls, one of which is facing the skin of the user and the other one facing away from the user. The two walls are connected to one another and define, in a lateral view, a U-shaped profile that forms a guide slot for a movable cutter blade. Hence, the stationary blade is a double-walled blade. This has the advantage that the first wall may be arranged in a considerably thinner fashion as the second wall provides the stationary blade with sufficient strength. Therefore, such an arrangement is suitable for trimming, as respective teeth may be provided at the stationary blade and the movable blade. Further, the blade set is suitable for shaving as the effective thickness of the first wall of the stationary blade is considerably reduced.

Hence, several approaches to the manufacture of double-walled stationary blades and respective blade sets have been proposed. However, at least some of the above-indicated approaches still involve relatively high manufacturing costs, particularly molding costs and tooling costs. In particular, a combined sheet metal and injection molding approach that involves insert molding or overmolding techniques, requires specific tools and manufacturing facilities. Further, relatively complex and cost-increasing auxiliary processes may be required, for instance grinding, lapping, deburring, etc.

Hence, in this respect, there is still room for improvement in the manufacture of blade sets for hair cutting appliances.

SUMMARY OF THE INVENTION

In view of the above, it is an object of the present disclosure to provide a stationary blade for a blade set of a hair cutting appliance and a corresponding method of manufacturing a stationary blade that enable a cost-efficient manufacture while maintaining the benefits of the double-walled design as discussed above. More particularly, it would be beneficial to present a method of manufacturing a stationary blade that primarily relies on rather simple manufacturing approaches that preferably do not require expensive tooling and complicated post-processing and/or assembly procedures. Further, it would be beneficial to dispense with hybrid manufacturing approaches that combine two or more rather distinct and different manufacturing methods (such as insert molding and/or overmolding of sheet metal components).

In other words, it would be beneficial to present a manufacturing approach that is based on conventional manufacturing methods but that enables the manufacture of stationary blades and blade sets in accordance with the above-indicated novel design approaches.

It is a further object of the present disclosure to provide a blade set that is equipped with a respective stationary blade and a movable blade that is movably retained in the stationary blade. Further, it is desirable to provide a hair cutting appliance to which a respective blade set may be mounted.

In a first aspect of the present disclosure a stationary blade for a blade set of a hair cutting appliance is presented, the stationary blade comprising:

a top wall, a bottom wall, and a guide slot formed therebetween to accommodate a movable blade, a plurality of stationary blade teeth each having a frontal end, wherein the top wall and the bottom wall are mutually joined at the frontal ends, wherein the top wall and the bottom wall are, at least at the frontal ends, made from sheet metal material, and wherein, at the frontal ends, two or more sheet metal folded edges are present.

This aspect is based on the insight that also with relatively simple and rather established manufacturing approaches, relatively complex stationary blades that provide a top wall and a bottom wall may be formed, wherein the provision of two or more sheet metal folded edges at the frontal ends greatly increases the freedom of design.

As a result, in some exemplary embodiments, the top wall may be considerably thinner than the bottom wall which, on one hand, improves the shaving performance and, on the other hand, maintains a desired minimum strength for the stationary blade.

In further exemplary embodiments, the two or more sheet metal folded edges at the frontal ends of the teeth of the stationary blade enable an increased strength of the stationary blade teeth as basically a plurality of layers may be provided that provide a greater rigidity than standard designs for sheet metal based teeth of stationary blades.

Hence, in accordance with the above presented aspect, the tooling for the manufacture of the stationary blade may be rather conventional, including folding equipment, and, in some exemplary embodiments, a relatively simple punching/cutting jig for sheet metal blanks.

More particularly, at least in some exemplary embodiments, the provision of complicated molding tools (including injection molding molds for insert molding and overmolding) and respective handling devices may be dispensed with.

In the following, definitions are provided that facilitate understanding major embodiments of the present disclosure. The definitions are primarily provided for clarifying and illustrative purposes, and are not intended to limit the scope of the present disclosure.

As used herein, a folded edge in accordance with the present disclosure may be referred to as a folding zone. That is, at the folded edge or folding zone, two legs of sheet metal material are formed by bending/folding. In some embodiments, the two legs that form a folded edge contact one another after the folding procedure. In certain embodiments, the two legs of a folded edge do not contact one another, i.e. a further portion of the sheet metal material that does not directly belong to the folded edge is placed therebetween. Generally, in major embodiments, the two legs of a folded edge or folding zone are parallel to one another after the folding procedure.

In the context of the present disclosure, the terms wall, layer and sheet are used to describe the sheet metal design of the stationary blade. A sheet may form one or more layers. Two or more layers of the sheet are present when one or more folded edges are provided. A sheet that comprises two layers has one respective folded edge. A sheet that comprises four layers has three adjacent folded edges. Further, in contrast thereto, a layer may not form two or more sheets. One sheet may form two or more adjacent (contacting or spaced apart) layers, as discussed before. A wall may comprise one layer, two layers, or even more layers. In some embodiments, a wall is formed by a single sheet. In other embodiments, a wall is formed by two or even more sheets.

In some embodiments, a bent inner sheet and a bent outer sheet are provided, wherein both the inner sheet and the outer sheet are present in the top wall and in the bottom wall, respectively. In alternative exemplary embodiments, a single multiply folded sheet forms both the top wall and the bottom wall of the stationary blade. At the frontal ends of the stationary blade teeth, a multiply folded sheet may form a fourfold or lower case omega-shaped arrangement at the frontal ends of the teeth. This design may also be referred to as M-shaped (lying M).

The plurality of folded edges at the frontal ends strengthens the teeth and, more generally, the stationary blade. Each teeth has two or more folded edges that are adjacent to one another.

In an exemplary embodiment of the stationary blade, in a rear portion of the frontal ends that is facing opposite teeth of the movable blade, a layer structure is provided that involves four layers formed by sheet metal material.

This has the advantage that a well-defined overall height or thickness of the stationary blade is defined. As a further result, the height of the guide slot is accurately defined by the thickness of the sheet metal material that forms the respective layers of the layer structure. Hence, the layers that may be manufactured with high accuracy define the height extension of the guide slot and thus the room that is provided for the movable blade that is provided therein in the assembled blade set.

Hence, an overall clearance for the movable blade in the guide slot can be very accurate and tight which results in an improved cutting and running performance.

In a further exemplary embodiment, the stationary blade comprises an inner sheet and an outer sheet, wherein the inner sheet is arranged inside the outer sheet. Hence, both the inner sheet and the outer sheet are present in each of the top wall and the bottom wall. Even at the frontal end of the teeth, where respective tips are formed, both the inner sheet and the outer sheet are present.

In a further exemplary embodiment of the stationary blade, the outer sheet is wrapped around the inner sheet. This applies in particular to the frontal ends of the stationary blade teeth. This has the effect that the stationary blade teeth are rigid and stiff. Further, by leaving out (removing) respective portions of the inner sheet in rear portions of the stationary blade teeth and the top wall, the guide slot may be defined.

In yet another exemplary embodiment of the stationary blade, the inner sheet comprises a single folded edge at the frontal ends, wherein the outer sheet comprises a single folded edge at the frontal ends, and wherein the inner sheet folded edge is nestled in the outer sheet folded edge. In other words, the outer sheet folded edge is wrapped around the inner sheet folded edge. At the inner sheet folded edge, respective legs contact one another. By contrast, respective legs of the outer sheet folded edge are spaced away from one another.

In still another exemplary embodiment of the stationary blade, the inner sheet comprises, adjacent to the folded edge, a top layer and a bottom layer that contact one another. In other words, the top layer and the bottom layer of the inner sheet are arranged on top of one another.

In yet another exemplary embodiment of the stationary blade, the top layer of the inner sheet defines a frontal end of the guide slot. Hence, the top layer of the inner sheet does not extend into a region that is left blank for the guide slot to accommodate the movable blade therein.

This measure has the result that the height of the guide slot is accurately defined by the thickness of the top layer of the inner sheet. A respective face of the inner sheet faces the tips of movable blade teeth of the movable blade that is accommodated in the guide slot.

In yet another exemplary embodiment of the stationary blade, the outer sheet comprises, adjacent to the folded edge, a top layer and a bottom layer that are spaced away from one another by the inner sheet. Hence, in a side view, the outer sheet is U-shaped (lying U) to form the top layer, the bottom layer and the folded edge that interconnects the top layer and the bottom layer.

Further, in some exemplary embodiments of the stationary blade, the guide slot for the movable blade extends between the top layer of the outer sheet and the bottom layer of the inner sheet. This has the effect that the top wall, particularly in the vicinity of the guide slot, may be considerably thin, whereas the bottom layer, in basically the same region (i.e. in the vicinity of the guide slot) may be at least partially significantly thicker as basically both the bottom layer of the inner sheet and the bottom layer of the outer sheet may be present.

In still another exemplary embodiment, the stationary blade comprises a first series of teeth at a first leading edge and a second series of teeth at a second leading edge, wherein the inner sheet connects the first leading edge and the second leading edge at the bottom wall, and wherein the outer sheet connects the first leading edge and the second leading edge at the top wall.

Generally, also in connection with other exemplary embodiments, the stationary blade may comprise a first series of teeth at a first leading edge and a second series of teeth at a second leading edge. In this way, the stationary blade and a respectively equipped blade set may be operable to cut hair in both a push and a pull movement. Further, the trimming and styling performance of the appliance may be improved. More generally, the ability to reach hard-to-reach areas may be improved.

Generally, when a first leading edge and a second leading edge is provided, the stationary blade may be arranged in a basically symmetric fashion, particularly in terms of the respective teeth.

However, in alternative embodiments, only a single leading edge is provided. Also such an embodiment may profit from at least some insights and aspects of the present disclosure.

In yet another exemplary embodiment of the stationary blade, a single sheet is provided that is multiply folded at the frontal ends of the teeth. Hence, more than one folded edge at the frontal ends of the teeth is defined by the single sheet in accordance with this embodiment.

In yet another exemplary embodiment of the stationary blade, the frontal ends of the teeth are formed by three folded edges, comprising an outwardly facing first folded edge, an outwardly facing second folded edge, and an inwardly facing third folded edge. Generally, the inwardly facing third folded edge is arranged between the first folded edge and the second folded edge that are outwardly facing. Hence, overall, a lower case omega-shaped or M-shaped design of the frontal end is provided.

Also in accordance with this embodiment, a considerable strengthening of the teeth at their frontal ends may be achieved.

In yet another exemplary embodiment, the stationary blade comprises a top layer, a bottom layer, a first inner layer and a second inner layer, wherein the first inner layer and the second inner layer are arranged between the top layer and the bottom layer, and wherein the first inner layer extends between the first folded edge and the third folded edge, and wherein the second inner layer extends between the third folded edge and the second folded edge.

As a result, at least in some more specific embodiments, the height of the guide slot may be defined by the first inner layer and the second inner layer when a respective space between the top layer and the bottom layer is left blank.

In yet another exemplary embodiment of the stationary blade, in a rear portion that is spaced away from the teeth, the bottom wall comprises an inwardly folded section comprising a first inwardly facing folded edge and a second outwardly facing folded edge that define a first rear inner layer and a second rear inner layer, wherein the first rear inner layer contacts a top layer, wherein the second rear inner layer contacts a bottom layer, wherein the portion of the single sheet that forms the first rear inner layer is, in an unfolded state, spaced away from the portion of the single sheet that forms the top layer.

Hence, also in a rear (or: central) portion that is facing away from the teeth, a connection or support between the top wall and the bottom wall may be defined by one and the same single sheet.

Generally, also in connection with the single sheet embodiment, the stationary blade may comprise a first series of teeth at a first leading edge and a second series of teeth at a second leading edge, wherein the top layer connects the first leading edge and the second leading edge.

In another aspect of the present disclosure there is presented a blade set for a haircutting appliance, the blade set comprising:

a stationary blade in accordance with at least one embodiment as described herein, and a moveable blade comprising a plurality of movable blade teeth, wherein in the guide slot of the stationary blade, an intermediate guide element is arranged between the top wall and the bottom wall, wherein in the movable blade, a guide recess is formed, wherein the intermediate guide element extends in the guide slot in such a way that the movable blade is movably retained, and particularly undetachably, and wherein the movable blade is arranged to be moved with respect to the stationary blade to cut hair, particularly in a reciprocating fashion.

In some specific embodiments, the intermediate guide element is formed by a separate component. In accordance with this embodiment, it may be necessary to join the movable blade and the intermediate guide element before inserting the subassembly that is formed in this way into the guide slot.

In an alternative embodiment, the intermediate guide element is an integral part of the sheet material that forms the top wall and the bottom wall in accordance with at least one embodiment of the stationary blade as described herein.

In yet another aspect of the present disclosure, there is presented a hair cutting appliance arranged to be moved through hair to cut hair, the appliance comprising:

a housing comprising a handle section, a drive unit arranged in the housing, and a cutting head comprising a blade set in accordance with at least one embodiment as described herein.

Generally, the blade set may comprise a basically linear leading edge defined by a respective series of stationary blade teeth (and movable blade teeth). In accordance with this embodiment, a basically reciprocating and substantially linear relative movement between the movable blade and the stationary blade is present. However, this does not exclude embodiments, wherein an at least somewhat curved (oscillatory) movement path of the movable blade with respect to the stationary blade is present. This may be caused, for instance, by a respective guiding linkage for the movable blade.

Further, in addition to basically linear arrangements of blade sets, also curved or even circular arrangements of blade sets may be envisaged. Hence, accordingly, a somewhat curved or circular leading edge defined by a respective arrangement of stationary blade teeth (and movable blade teeth) may be provided. Therefore, whenever reference herein is made to a longitudinal direction, a lateral direction and/or a height direction, this shall not be interpreted in a limiting sense. A curved or circular blade set may be defined and described with reference to similar directions, but also with reference to polar directions and/or further appropriate directional information. Hence, Cartesian coordinate systems, but also polar coordinate systems and further appropriate coordinate systems may be used to describe linear and/or curved designs of blade sets.

In some embodiments, the blade set is provided with two opposite leading edges, i.e. two opposite series of stationary blade teeth and movable blade teeth. In this way, both a pulling and a pushing movement of the blade set may be used for the cutting operation. Further, in this way the hair cutting appliance is more flexible which may facilitate styling operations and hair cutting operations in hard-to-reach areas.

In still another aspect of the present disclosure, there is presented a hair cutting appliance that is arranged to be moved through hair to cut hair, the appliance comprising:

a housing comprising a handle section, a drive unit arranged in the housing, and a cutting head comprising a blade set in accordance with at least one embodiment as discussed herein.

Generally, the cutting head may be referred to as processing head. Generally, the hair cutting appliance may be referred to as grooming appliance. A hair cutting appliance may be arranged as a trimming appliance, a shaving appliance, and/or a combined trimming and shaving appliance.

The appliance may be arranged as an electrically powered appliance. The appliance may be arranged as a wireless appliance, powered by an integrated battery, or as a line-powered appliance.

In still another exemplary embodiment of the present disclosure, there is presented a method of manufacturing a sheet metal based stationary blade of a blade set for a haircutting appliance, the method comprising the steps of:

providing a sheet metal blank, forming a basically flat sheet metal component, forming at least one pattern of slots in the sheet metal component, thereby defining at least one toothed leading edge, multiply folding the sheet metal component, thereby forming:

- a top wall, a bottom wall, and a guide slot formed therebetween to accommodate a movable blade
- a plurality of stationary blade teeth each having a frontal end,
- wherein the top wall and the bottom wall are mutually joined at the frontal ends, and
- wherein, at the frontal ends, two or more sheet metal folded edges are formed.

The above illustrated order of steps is not necessarily fixed. In other words, at least some steps may be interchangeable in accordance with respective embodiments.

More particularly, the step of multiply folding the sheet metal component may involve folding a first sheet metal blank that forms the outer sheet, and folding a second sheet metal blank that forms the inner sheet. Hence, in accordance with this embodiment, the step of providing a sheet metal blank involves providing and forming two or more basically flat sheet metal components that form the inner sheet and the outer sheet.

Further, the method may involve the step of joining the inner sheet and the outer sheet, wherein the outer sheet is wrapped around the inner sheet at the frontal edges of the stationary blade teeth.

Preferred embodiments of the invention are defined in the dependent claims. It shall be understood that the claimed method has similar and/or identical preferred embodiments as the claimed devices and as defined in the dependent claims.

BRIEF DESCRIPTION OF THE DRAWINGS

These and other aspects of the disclosure will be apparent from and elucidated with reference to the embodiments described hereinafter. In the following drawings.

DETAILED DESCRIPTION OF THE INVENTION

Figure 1:
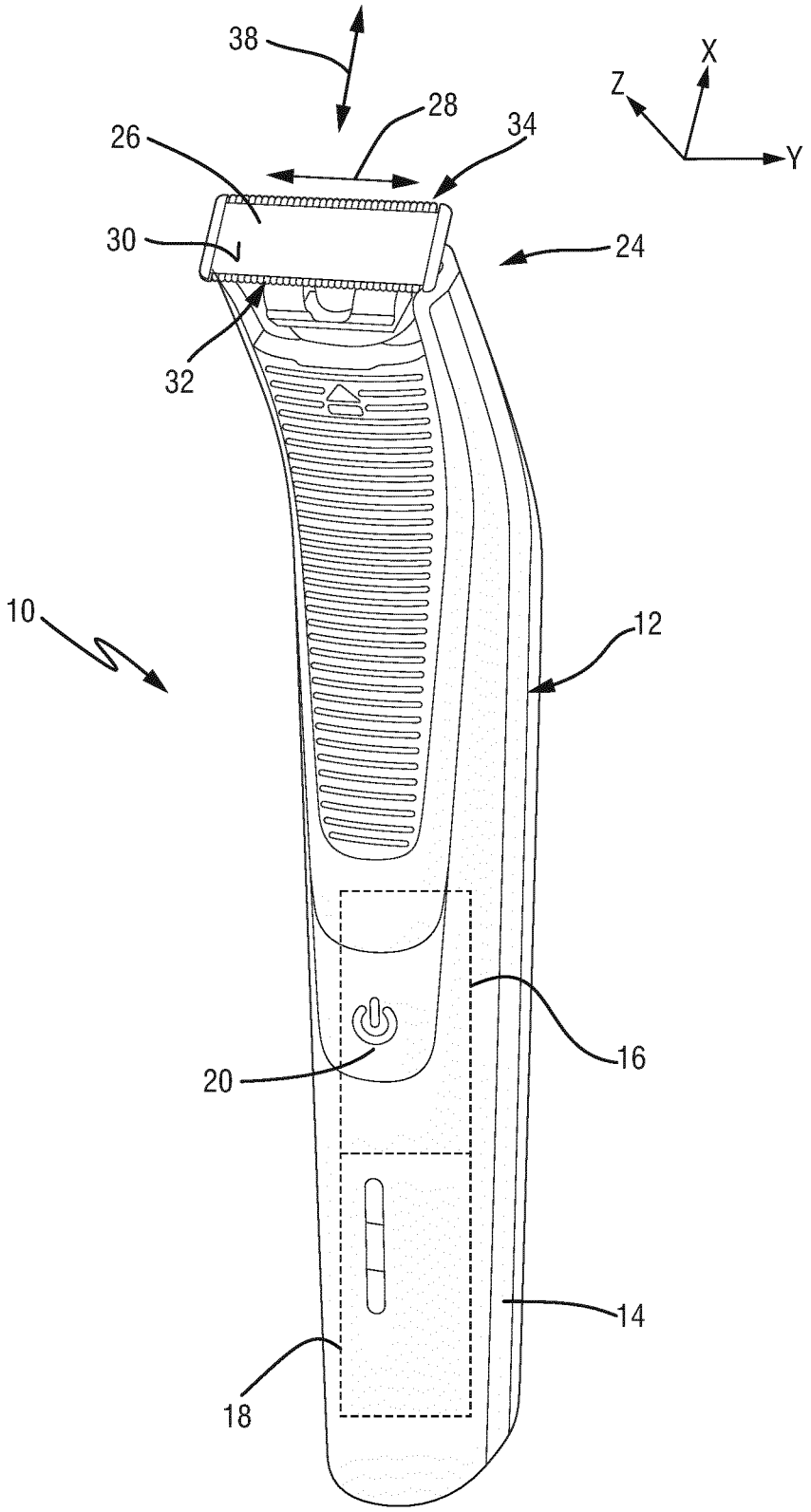
FIG. 1 shows a perspective frontal view of an exemplary embodiment of a hair cutting appliance.

FIG. 1 shows a perspective frontal view of a hair cutting appliance 10. The hair cutting appliance 10 is arranged as an appliance that is capable of both trimming and shaving.

The appliance 10 comprises a housing 12 which is arranged in an elongated fashion. At the housing 12, a handle section 14 is defined. In the housing 12, a drive unit 16 is arranged. Further, a battery 18 may be arranged in the housing 12. In FIG. 1, the drive unit 16 and the battery 18 are represented by dashed blocks. At the housing 12, operator controls 20 such as on/off buttons and the like may be provided.

At a top end thereof, the appliance 10 comprises a processing head 24 that is attached to the housing 12. The processing head 24 comprises a blade set 26. The blade set 26, particularly a movable blade thereof, may be actuated and driven by the drive unit 16 in a reciprocating fashion, refer also to the double arrow 28 in FIG. 1. As a result, respective teeth of the blades of the blade set 26 are moved with respect to one another, thereby effecting a cutting action. A top side or top surface of the blade set 26 is indicated by 30 in FIG. 1.

The blades of the blade set 26 may be arranged at a first leading edge 32 and, in at least some embodiments, at a second leading edge 34 that is opposite to the first leading edge 32. The first leading edge 32 may be also referred to as frontal leading edge. A second leading edge 34 may be also referred to as rear leading edge.

Further, a general advancing or moving direction of the appliance 10 is indicated in FIG. 1 by a double arrow 38. As the blade set 26 of the exemplary embodiment of FIG. 1 is equipped with two leading edges 32, 34, a push and a pull movement may be used to cut hair.

In the following, exemplary embodiments of stationary blades and blade sets 26 will be elucidated and described in more detail. The blade sets 26 may be attached to the appliance 10, or to a similar appliance. It goes without saying the single features disclosed in the context of a respective embodiment may be combined with any of the other embodiments, also in isolated fashion, thereby forming further embodiments that still fall under the scope of the present disclosure.

In some Figures shown herein, exemplary coordinate systems are shown for illustrative purposes. As used herein, an X-axis is assigned to a longitudinal direction. Further, a Y-axis is assigned to a lateral direction. Accordingly, a Z-axis is assigned to a vertical (height) direction. Respective associations of the axes/directions X, Y, Z with respective features and extensions of the blade set 26 can be derived from those Figures. It should be understood that the coordinate system X, Y, Z is primarily provided for illustrative purposes and not intended to limit the scope of the disclosure. This involves that the skilled person may readily convert and transform the coordinate system when being confronted with further embodiments, illustrations and deviating view orientations. Also a conversation of Cartesian coordinate systems into polar coordinate system may be envisaged, particularly in the context of a circular or curved blade set.

Figure 2:
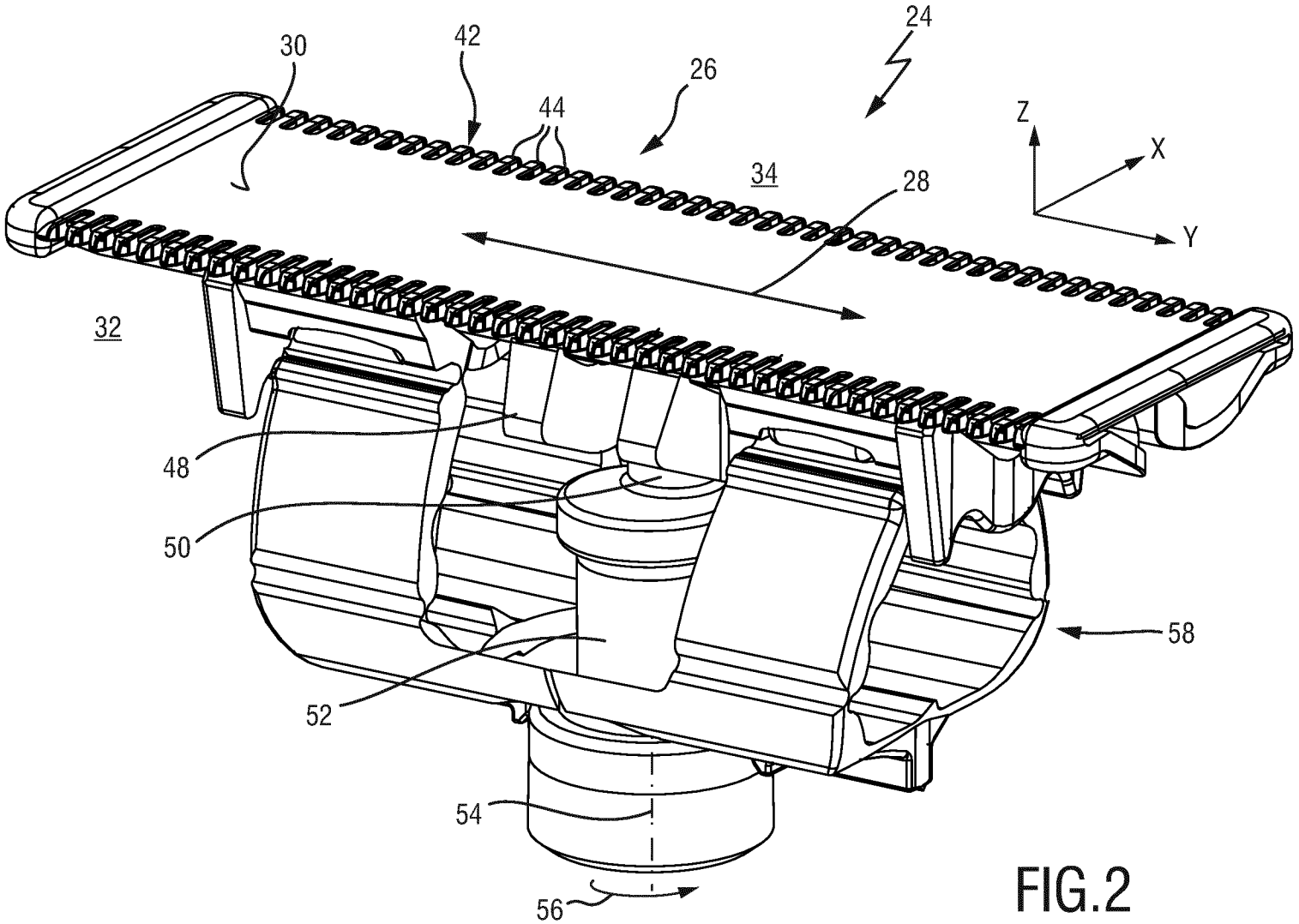
FIG. 2 shows a perspective top view of an exemplary embodiment of a blade set for a hair cutting appliance.

In FIG. 2, a perspective view of a blade set 26 for a processing head or cutting head 24 of a hair cutting appliance 10 is shown. As with the embodiment shown in FIG. 1, a cutting direction and/or a direction of a relative movement of blades of the blade set 26 is indicated by an arrow 28. A top side of the blade set 26 that is facing the user when the appliance 10 is operated is indicated by 30. In the exemplary embodiment shown in FIG. 2, the blade set 26 is provided with a first leading edge 32 and a second leading edge 34. In FIG. 2 a stationary blade 42 of the blade set 26 is shown. A movable blade (cutter blade) is covered by the stationary blade 42 in FIG. 2. Stationary blade teeth are indicated by 44.

The movable blade of the blade set 26 that is not visible in FIG. 2 is operated and actuated via a driving engagement element 48 that may also be referred to as driving bridge. At the element 48, a driving or engagement slot is formed that is engaged by a driving pin 50 of a driving shaft 52. The driving shaft 52 is rotated about a driving axis 54, refer to a curved arrow 56. The driving pin 50 is off-centered with respect to the driving axis 54. Consequently, as the driving pin 50 is revolving, a reciprocating movement of the movable blade with respect to the stationary blade 42 is effected.

In FIG. 2, there is further indicated a pivot mechanism 58 which may be referred to as a contour following feature. The mechanism 58 enables a certain pivot movement of the blade set 26 about the Y-axis.

With reference to FIGS. 3 to 19, exemplary embodiments of blade sets that are operable in an appliance 10 as shown in FIG. 1 and a processing head 24 as shown in FIG. 2 will be illustrated and described in more detail.

Figure 3:
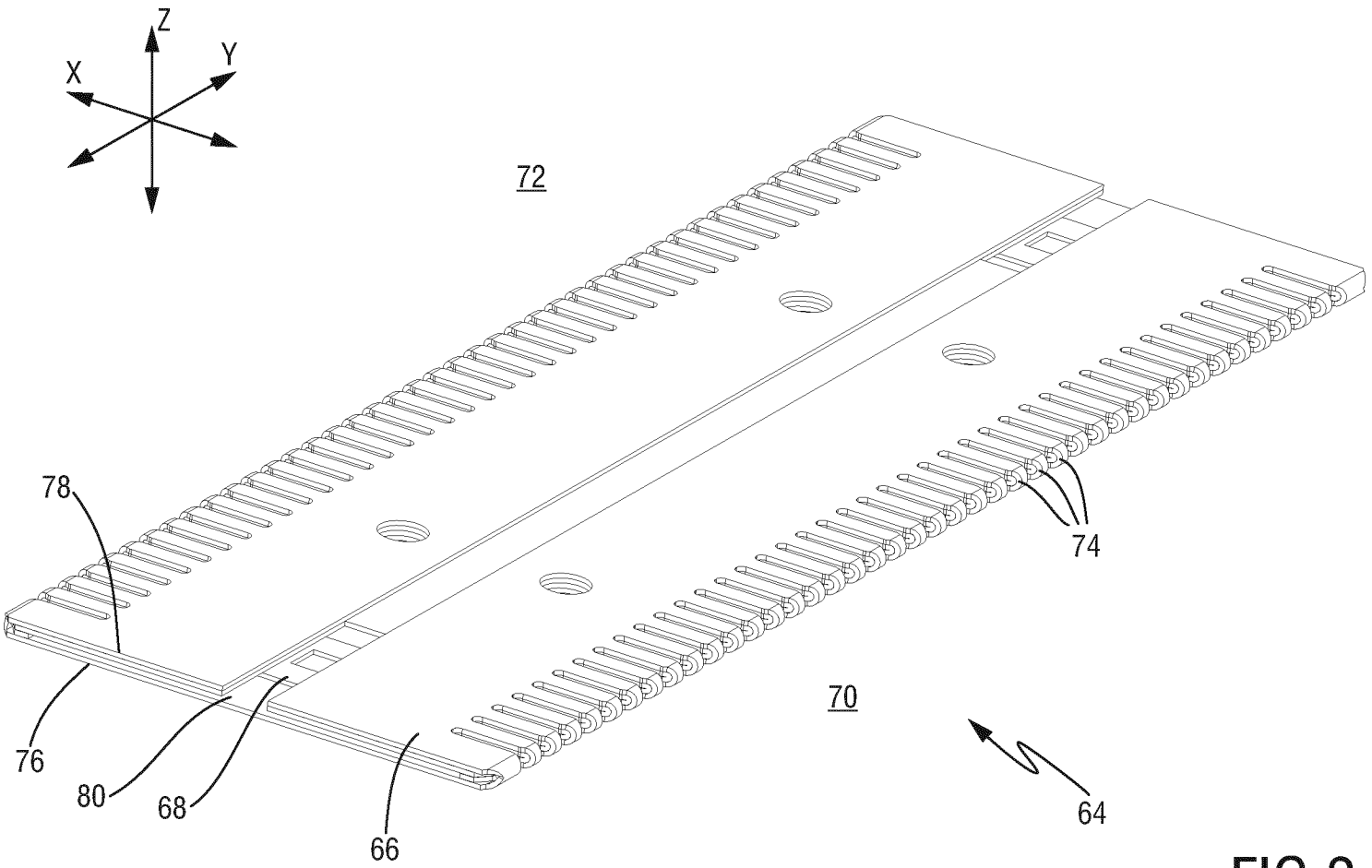
FIG. 3 shows a perspective bottom view of an exemplary embodiment of a blade set for a hair cutting appliance.

FIG. 3 shows a perspective bottom view of a first embodiment of a blade set 64 in accordance with the present disclosure. As with the blade set 26 exemplarily illustrated in FIG. 2, also the blade set 64 comprises a stationary blade 66 which may also be referred to as guard, and a movable blade 68 which may also be referred to as cutter. In FIG. 3, the movable blade 68 is largely covered by the stationary blade 66.

The blade set 64 comprises a first leading edge 70 and a second leading edge 72. At the stationary blade 66, stationary blade teeth 74 are provided both at the first leading edge 70 and the second leading edge 72.

With reference to FIG. 3, and with additional reference to FIGS. 4 to 10, aspects and features of the blade set 64 will be illustrated and further detailed.

The stationary blade 66 comprises a top wall 76, a bottom wall 78, and a guide slot 80 formed therebetween. The top wall 76 faces and contacts the user when an appliance implementing the blade set 64 is operated to cut hair. Hence, the bottom wall 78 is facing away from the user and facing the housing (reference numeral 12 in FIG. 1).

Figure 4:
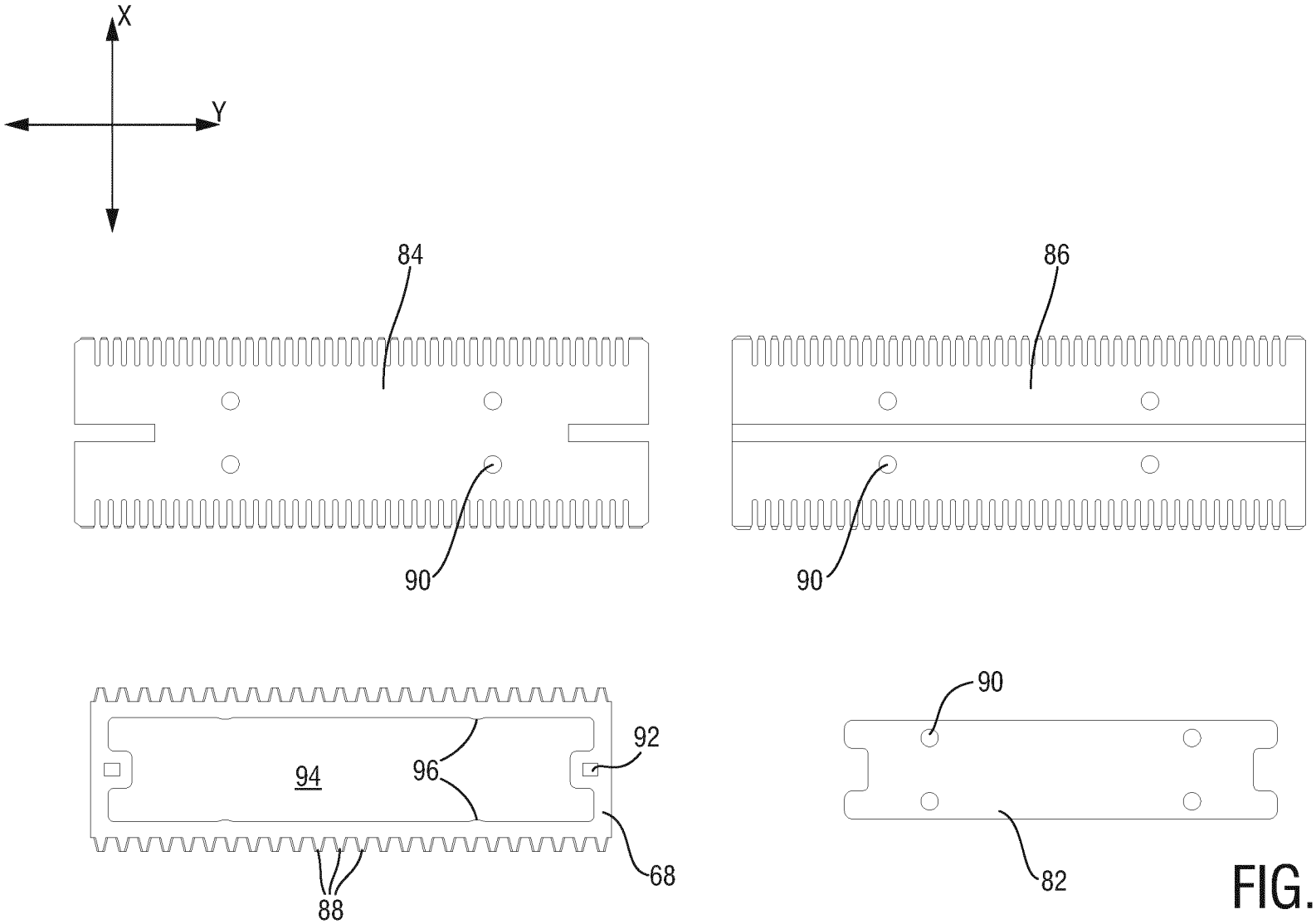
FIG. 4 shows a bottom plan view of the arrangement of FIG. 3 in a exploded state.

FIG. 4 illustrates that in accordance with the embodiment described in FIG. 3 to FIG. 10, the stationary blade 66 comprises a so-called intermediate guide element 82 that matches a respective slot or window (guide recess 94) at the movable blade 68 to guide and retain the movable blade 68 in the guide slot 80. In an assembled state, the intermediate guide element 82 forms a portion of the stationary blade 66.

Hence, the intermediate guide element 82 and the movable blade 68 have to be mounted to the guide slot 80 in a joined state.

The outer sheet 86 may be regarded as an outer shell. The inner sheet 84 may be regarded as an inner shell. The outer sheet 86 is wrapped around the inner sheet 84. Together, the outer sheet 86 and the inner sheet 84 define the top wall and the bottom wall 78 and the guide slot 80 extending therebetween.

In FIG. 4, movable blade teeth are indicated by reference numeral 68. Further, so-called alignment features 90 are provided at some of the components of the blade set 64. Alignment features 90 formed as recesses or holes are provided at the intermediate guide element 82, the inner sheet 84 and the outer sheet 86. In some embodiments, the alignment features ensure a proper and accurate alignment or the respective layers or sheets.

In the guide recess 94 formed in the movable blade 68, contact elements 96 are provided that are arranged as contact protrusions. The contact elements 96 are arranged to contact guide surfaces at the intermediate guide element 82 as the movable blade 68 is reciprocatingly driven in the guide slot 80 of the stationary blade 66.

In FIG. 4, connector zones 92 that are arranged as mounting recesses are provided at the movable blade 68. The connector zones 92 are arranged to be contacted or engaged by a driving element (refer to driving element 48 in FIG. 2) to operate the movable blade 68.

Figure 5:
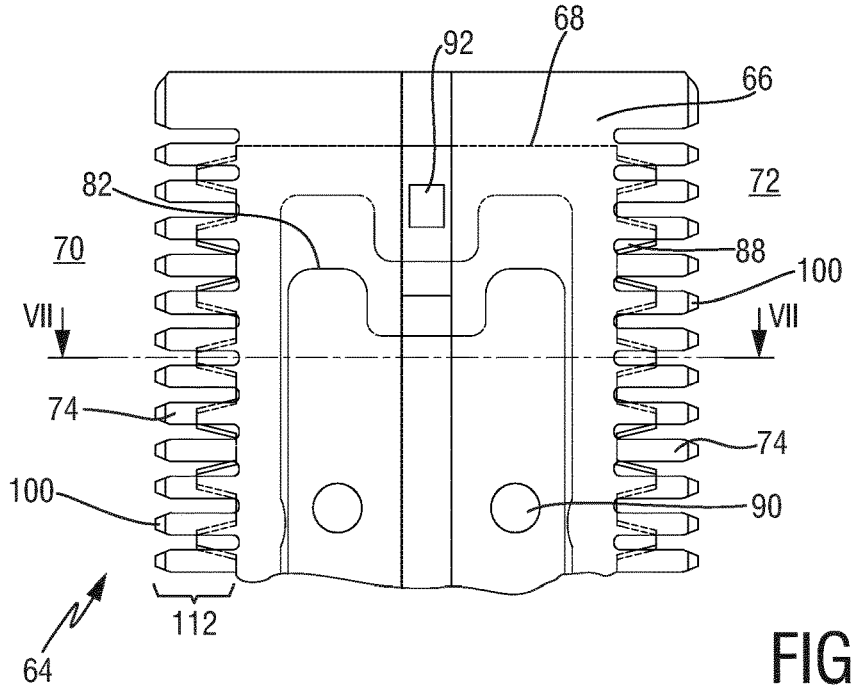
FIG. 5 is a partial top plan view of the arrangement of FIG. 3 including a hidden edge presentation.

Particular reference is made to FIG. 5, FIG. 6, FIG. 7 and FIG. 8. FIG. 5 illustrates an assembled state of the blade set 64, wherein hidden components are shown in a hidden edge mode. The teeth 74 of the stationary blade 66 comprise frontal ends 100 that form respective tips. As can be best seen from FIGS. 6 to 8, the frontal ends 100 are mutually formed by a contact between the top wall 76 and the bottom wall 78.

At the inner sheet 84, a folded edge 106 is provided at the frontal end 100 of the teeth 74. At the outer sheet 86, a folded edge 108 is provided at the frontal end 100 at the teeth 74. The folded edge 106 is nestled in the folded edge 108. This applies to both the first leading edge 70 and the second leading edge 72 at opposite sides of the blade set 64, refer to FIG. 3.

Figure 6:
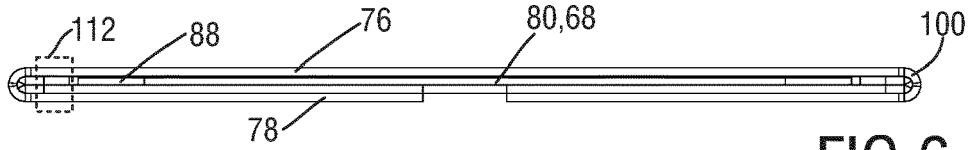
FIG. 6 is an enlarged lateral view of the arrangement of FIG. 5.
Figure 7:
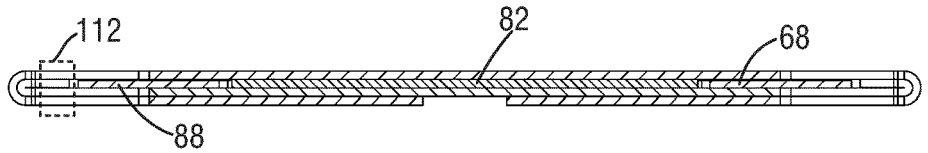
FIG. 7 is an enlarged lateral cross-section along the line VII-VII in FIG. 5.
Figure 8:
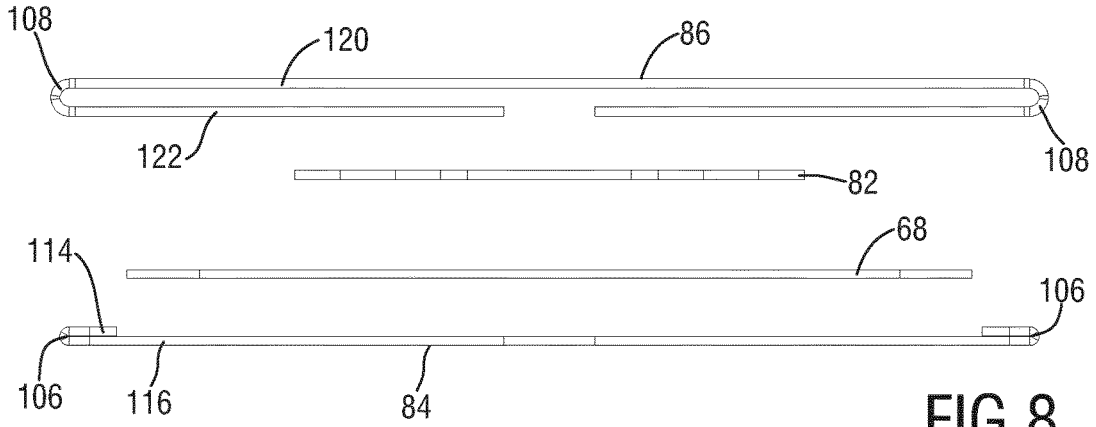
FIG. 8 is an enlarged lateral exploded view of the arrangement of FIG. 5.

In any of FIGS. 5, 6 and 7, a rear portion of the teeth 74 is indicated by 112. In the rear portion 112, the inner sheet 84 forms a top layer 114 and a bottom layer 116 that contact one another. Further, the outer sheet 86 forms, in the rear portion 112, a top layer 120 and a bottom layer 122 that are spaced away from one another by the top layer 114 and the bottom layer 116 of the inner sheet 84. The top layer 114 of the inner sheet 84 defines a frontal end of the guide slot 80 that is provided for the movable blade 86.

The terms "top" and "bottom" as recited in the claims are defined as directions relative to the orientation of the stationary blade as shown in FIG. 7, whereas the "frontal" direction as recited in the claims is defined as referring to either of the left and right ends of the stationary blade when oriented as shown in FIG. 7.

Overall, the inner sheet 84 and the outer sheet 86 define a layered arrangement having four layers 114, 116, 120, 122 that are arranged, in the rear portion 112 of the teeth 74 on top of one another. The top layer 114 and the top layer 120 jointly define the top wall 76. The bottom layer 116 and the bottom layer 122 jointly define the bottom wall 78.

Hence, as can be best seen in FIG. 6 and FIG. 7, the bottom wall 78 is thicker than the top wall 76 of the stationary blade 66. The guide slot 80 is formed between the top layer 120 of the outer sheet 86 and the bottom layer 116 of the inner sheet 84.

Figure 9:
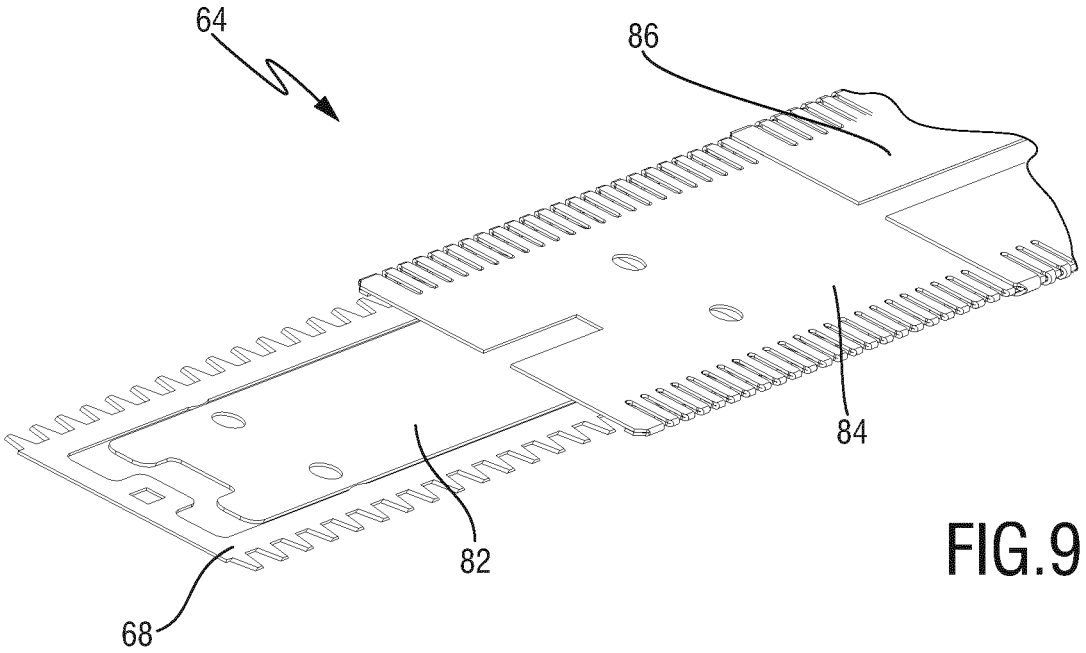
FIG. 9 is a partial view of the arrangement of FIG. 3 in a partially detached state.
Figure 10:
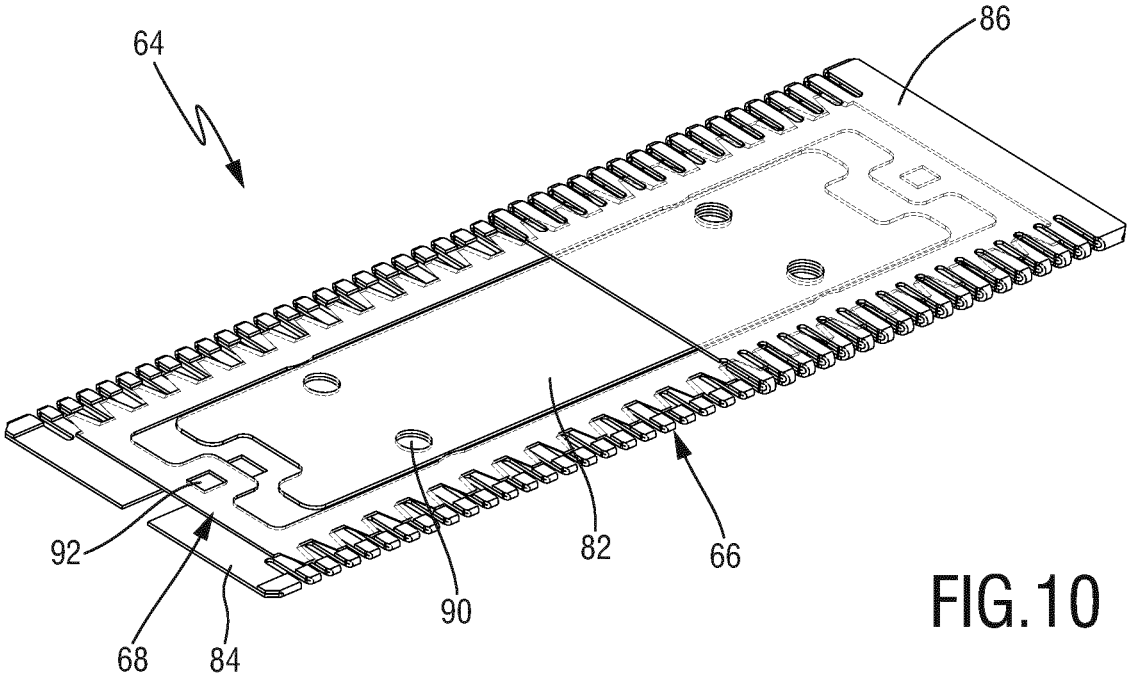
FIG. 10 is a perspective top view of the arrangement of FIGS. 3 to 9 in a hidden edge representation, wherein an outer sheet is partially omitted for illustrative purposes.

FIG. 9 illustrates the layered arrangement of the components of the blade set 64. Similarly, FIG. 10 illustrates the blade set 64 in a mounted state, wherein for illustrative purposes, the outer sheet 86 is partially omitted.

By providing two folded sheets 84, 86, the freedom of design may be greatly enlarged, resulting in differently sized walls at the top and the bottom of the stationary blade 66.

Figure 11:
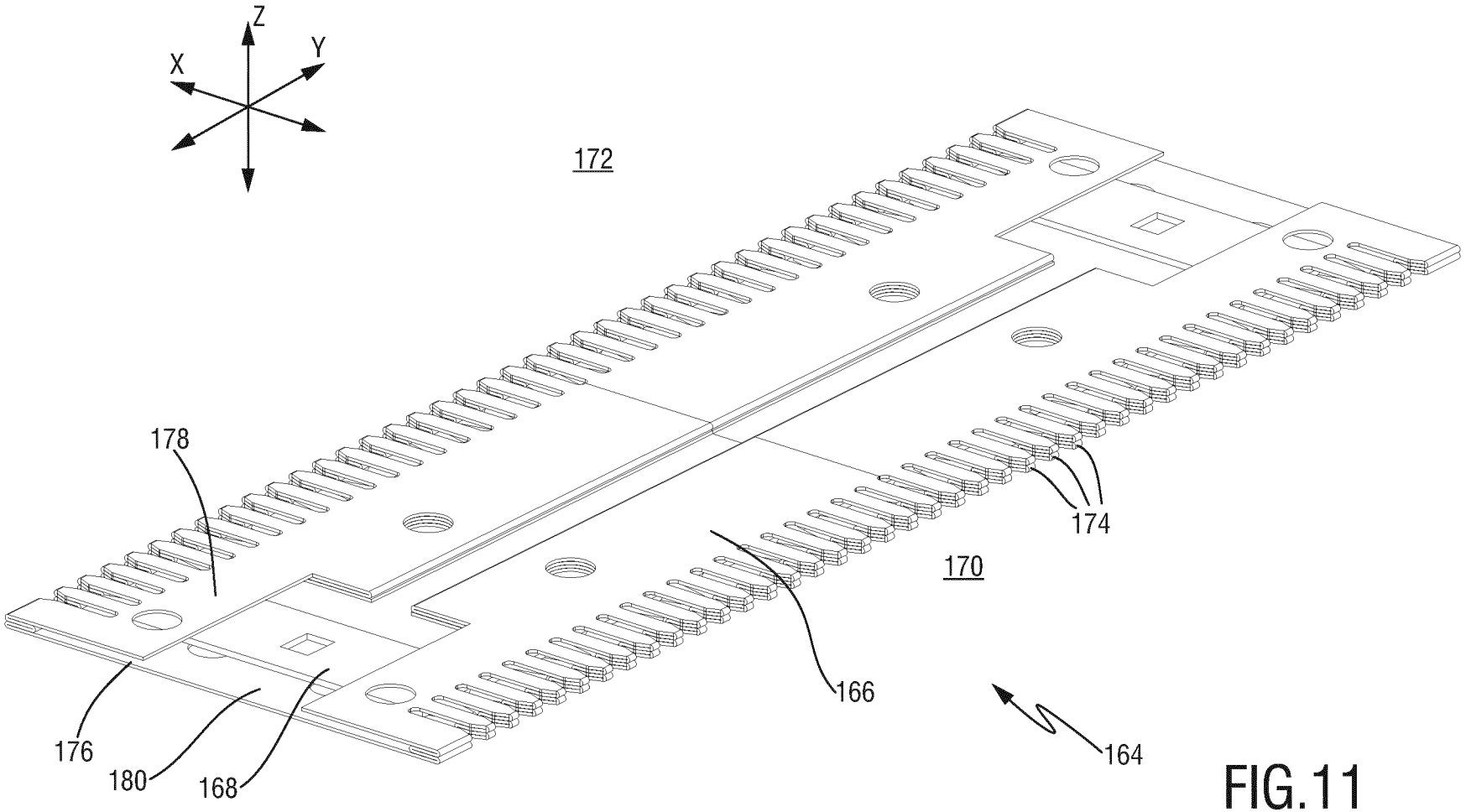
FIG. 11 is a perspective top view of a further exemplary embodiment of a blade set for a hair cutting appliance.
Figure 12:
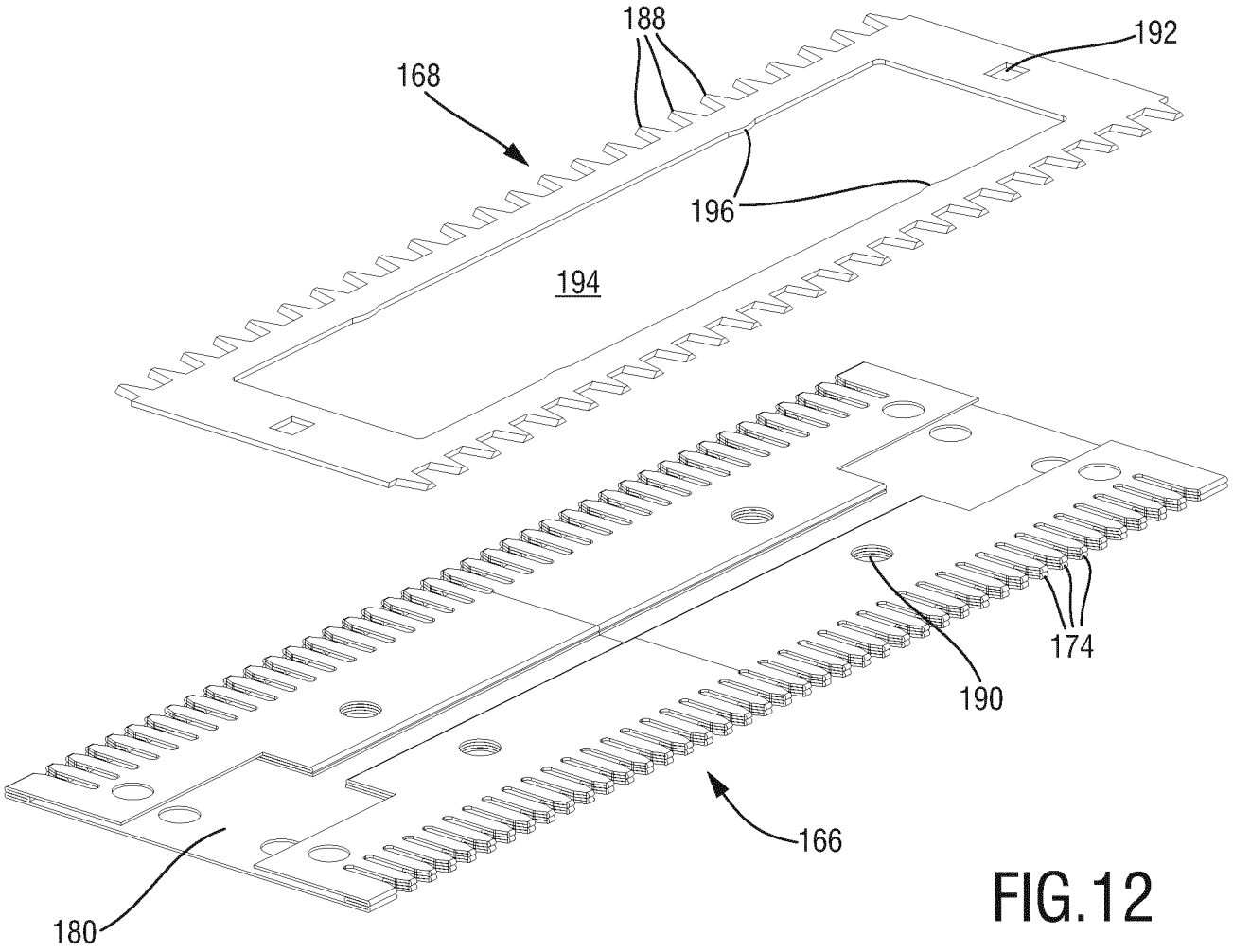
FIG. 12 is an exploded view of the arrangement of FIG. 11.

With reference to FIG. 11 to FIG. 19, a further exemplary embodiment of a sheet metal based blade set 164 is illustrated and further detailed. FIG. 11 is a perspective bottom view of the blade set 164. FIG. 12 is a corresponding exploded view. The blade set 164 comprises a stationary blade 166 and a movable blade 168. The blade set 164 forms a first leading edge 170 and a second leading edge 172. At each of the first leading edge 170 and the second leading edge 172, teeth 174 of the stationary blade 166 are provided. The stationary blade 166 comprises a top wall 176 and a bottom wall 178 that define therebetween a guide slot 180 to accommodate the movable blade 168. To form the stationary blade 166, a single sheet 184 is used. Further, in accordance with the exemplary embodiment of FIGS. 11 to 19, no separate, distinct intermediate guide element (refer to reference numeral 82 in FIGS. 3 to 10) is present. Teeth of the movable blade 168 are indicated by 188 in FIG. 12. Further, as with the stationary blade 68 illustrated herein before, also the movable blade 168 comprises a guide window or guide recess 194, wherein contact elements 196 are provided that cooperate with a corresponding guide contour of the single sheet stationary blade 166. The contact elements 196 may be referred to as contact protrusions that contact corresponding guide walls or guide faces in the guide slot 180 of the stationary blade 166.

Figure 13:
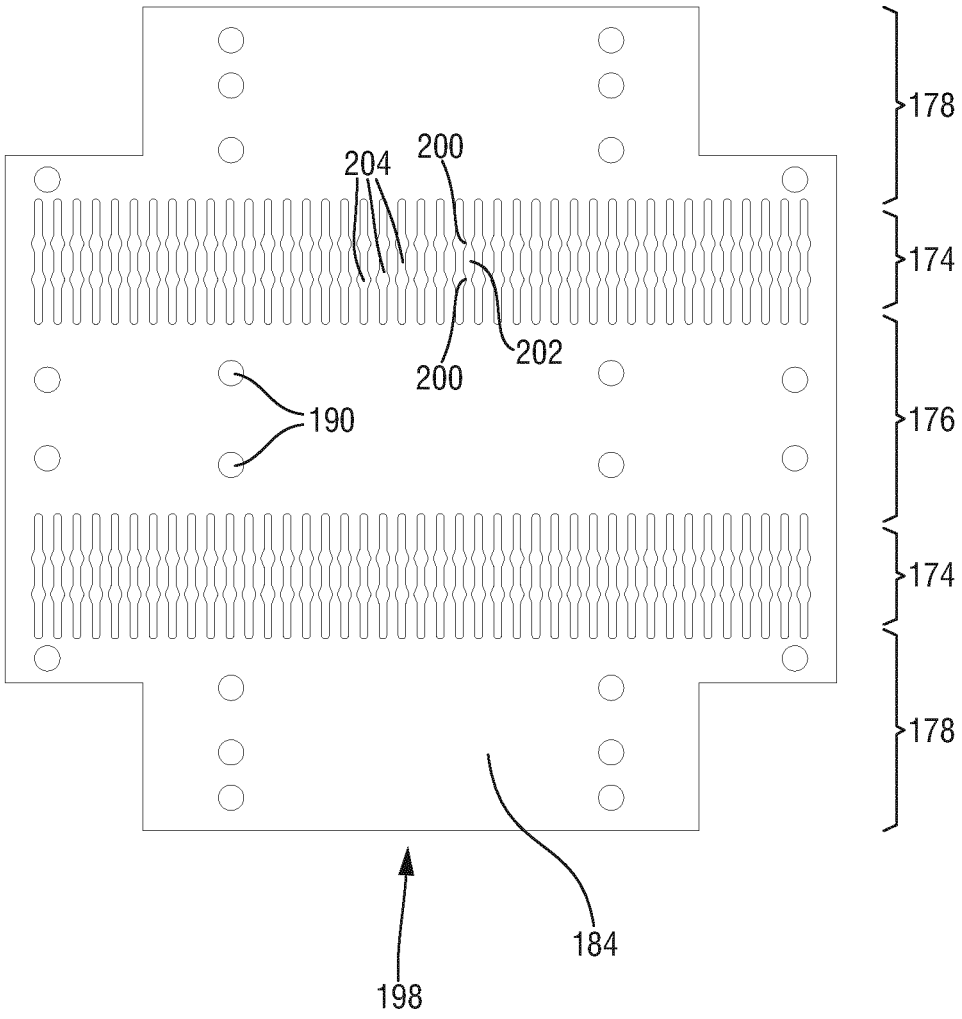
FIG. 13 is a unfolded view of a blank that forms a single sheet used in the arrangement of FIG. 11 and FIG. 12 to form a stationary blade thereof.

Further, alignment features 190 are indicated in FIG. 12, refer also to FIG. 13 in this context. The alignment features 190 contribute to a final accurately folded shape of the single sheet 184 that forms the stationary blade 166.

Further, as with the embodiment illustrated in FIGS. 3 to 10, also the movable blade 168 shown in FIG. 12 is provided with a connector zone 192 or connector geometry for a respective driving element.

Figure 14:
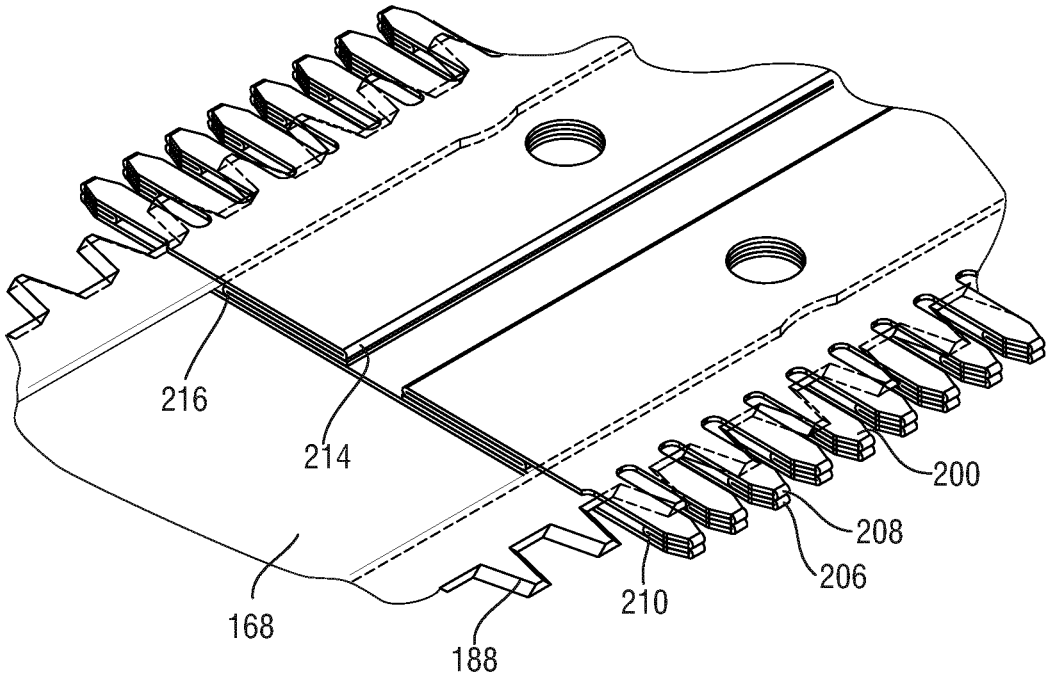
FIG. 14 is an enlarged perspective bottom view of the arrangement of FIG. 11 in a partially detached state.
Figure 15:
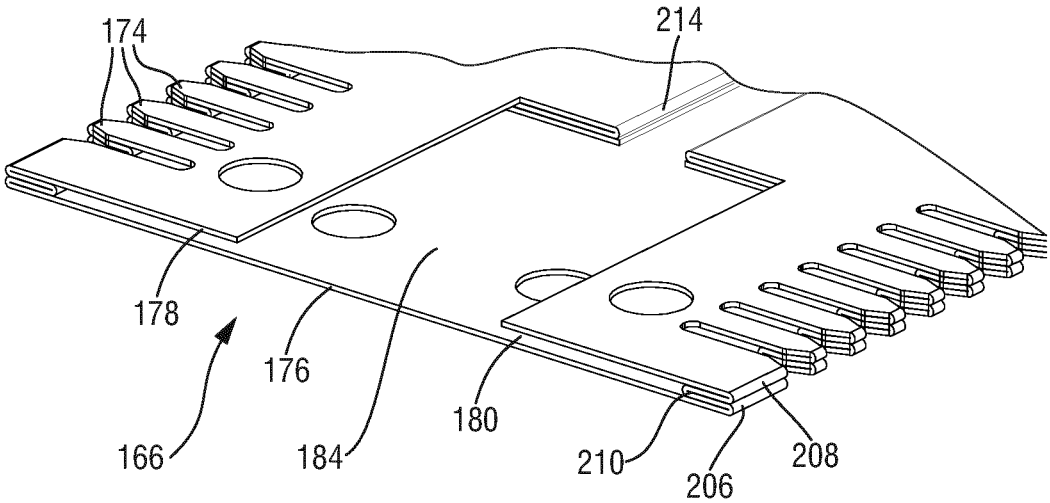
FIG. 15 is an enlarged perspective bottom detail view of the stationary blade of the embodiment illustrated in FIGS. 11 to 14.

FIG. 13 illustrates a flat blank 198 from which the single sheet 184 may be obtained by punching or stamping. In the unfolded state, respective portions are arranged in a series that define in the finally folded state the teeth 174, the top wall 176, and the bottom wall 178. Further, tips or frontal ends 200 are illustrated in FIG. 13, wherein at each teeth 174, in the unfolded state, two frontal ends 200 are provided, and wherein an inward portion 202 is formed therebetween. The series of teeth 174 is provided in a respective pattern for both the first leading edge 170 and the second leading edge 172 in the blank 198 illustrated in FIG. 13. The series of teeth 174 may be defined by forming respective slots 204 between neighboring teeth. Further reference is made to FIG. 14 and FIG. 15, illustrating the stationary blade 166 in a folded state. In FIG. 14, the movable blade 168 is arranged in the guide slot 180 of the stationary blade 166. A guide for the movable blade 168 is provided by folded edges 214, 216 in a central or back portion 218 of the stationary blade 166. In this connection, further reference is made to FIG. 17, FIG. 18 and FIG. 19.

FIG. 14 and FIG. 15 show that frontal ends 200 of the teeth 174 of the stationary blade 166 are formed by multiply folding the single sheet 184. In this way, folded edges 206, 208, 210 are formed at the frontal ends 200. The folded edge 206 may be referred to as top folded edge. The folded edge 208 may be referred to as bottom folded edge. The folded edge 210 may be referred to as intermediate folded edge. Overall, the frontal end 200 of the teeth 174 are M-shaped or lower case omega-shaped.

Figure 16:
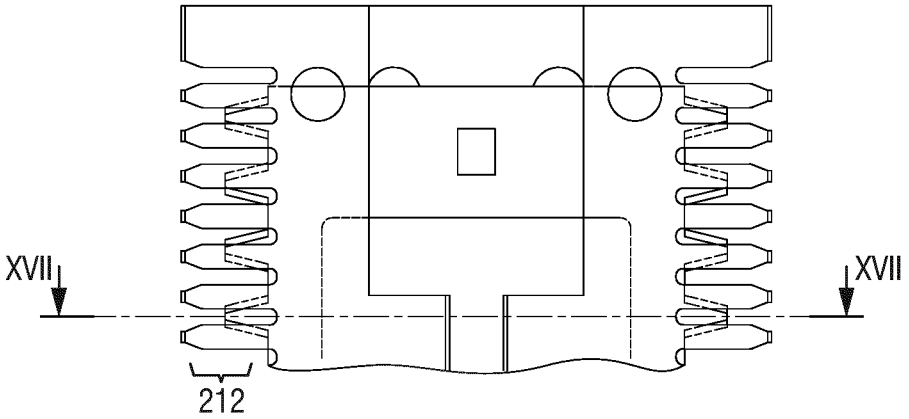
FIG. 16 is a partial top plan view of the arrangement of FIG. 11 including a hidden edge presentation.
Figure 17:
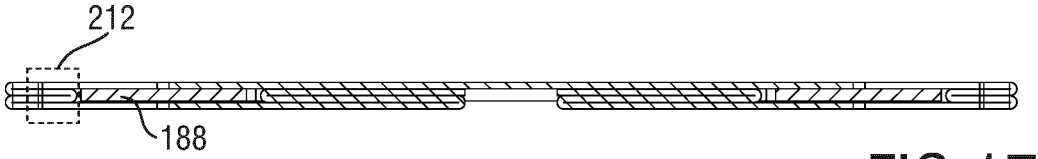
FIG. 17 is an enlarged lateral cross-section along the line XVII-XVII in FIG. 16.
Figure 18:
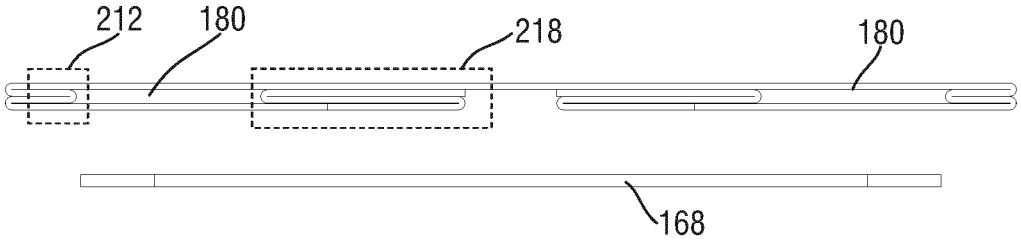
FIG. 18 is an enlarged exploded lateral view of the arrangement of FIG. 16.

In FIG. 16, FIG. 17 and FIG. 18, rear portions of the teeth 174 are indicated by dashed boxes. In the rear portion 212, the folded edges 206, 208, 210 define a frontal end of the guide slot 180.

Figure 19:
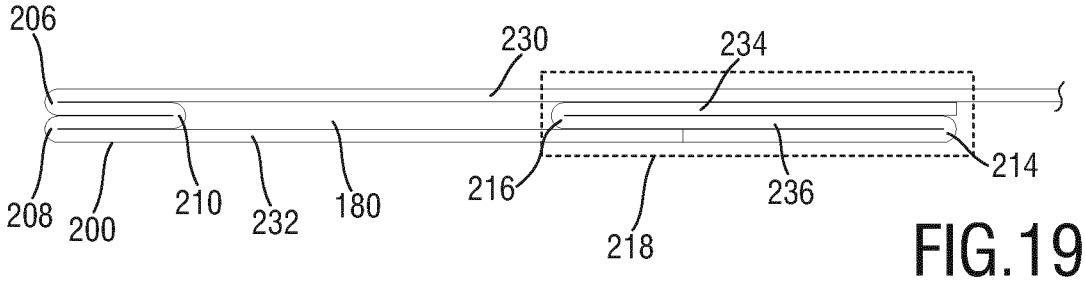
FIG. 19 is an even further enlarged partial detail lateral view of the stationary blade illustrated in FIG. 17 and FIG. 18.

Further, as shown in FIG. 19 in more detail, at the back portion 218 of the stationary blade 166, folded edges 214, 216 are present that provide for a contact or connection between the top wall 176 and the bottom wall 178. The folded edge 214 is a rearwardly facing folded edge. The folded edge 216 is a frontal folded edge. The movable blade 168 is guided between the folded edges 210, 216.

The single sheet 184 forms a top layer 230, a bottom layer 232, a first inner layer 234, and a second inner layer 236. In this way, using only a single sheet 184, a double walled stationary blade 166 and a precisely shaped and delimited guide slot 180 for the movable blade 168 may be formed. Further, the height of the guide slot 180 is accurately defined by the respective height (thickness) of the inner layers 234, 236 that is basically constant all over the sheet 180.

Figure 20:
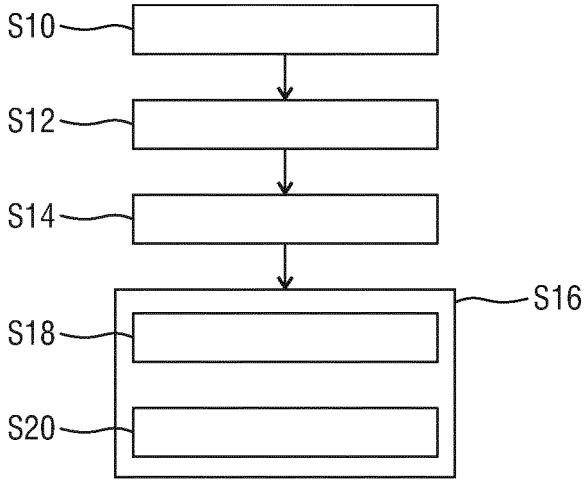
FIG. 20 is a block diagram illustrating an exemplary embodiment of a method of manufacturing a stationary blade of a blade set.

Reference is made to FIG. 20, illustrating an exemplary embodiment of a method of forming a stationary blade for a blade set of a hair cutting appliance. In a first step S10, a sheet metal blank is provided. In a subsequent step S12, a sheet metal component is obtained therefrom. The step S12 may involve a punching or cutting operation. Further, in a step S14, a series of slots is formed in the sheet metal component that defines a series of teeth in the final state of the stationary blade. The steps S12 and S14 may be performed simultaneously.

Having prepared a semi-finished product in this way, a folding step S16 may be started. As illustrated in FIG. 20, the following step S16 may involve sub steps S18, S20, each involving the formation of one folded edge. In this way, the sheet metal component may be folded two or more times to form a double-walled stationary blade that defines a guide slot, wherein at least one leading edge having a plurality of teeth is provided, wherein the teeth are, at a frontal end thereof, defined by two or more folded edges of the sheet metal material.

Figure 21:
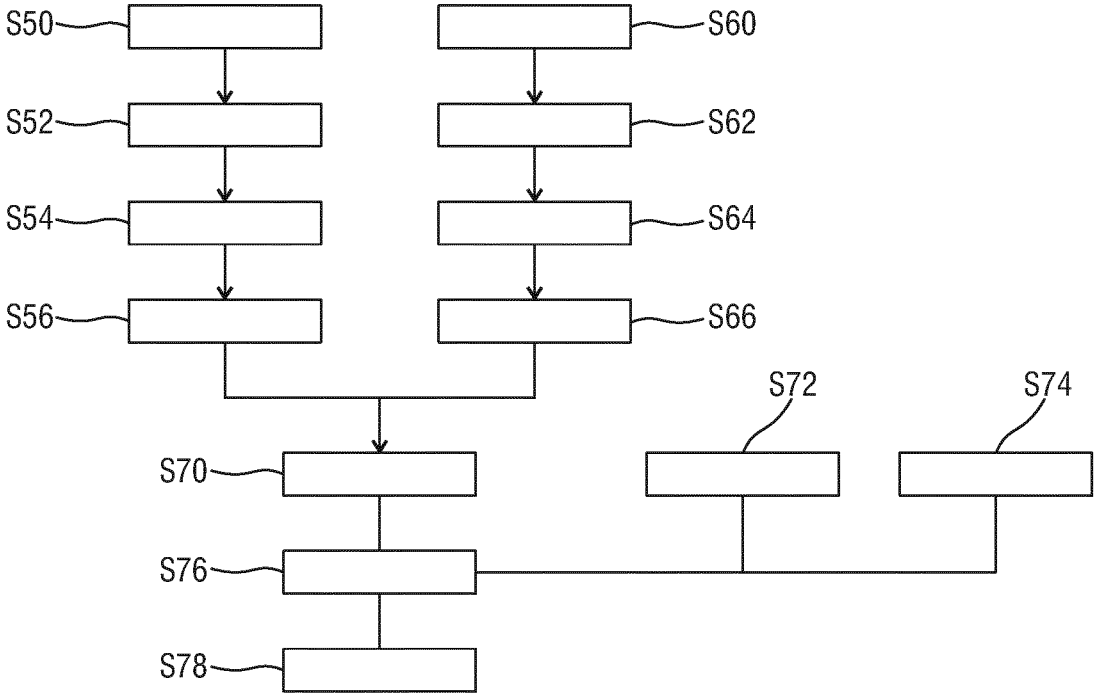
FIG. 21 is a block diagram illustrating an exemplary embodiment of a method of manufacturing a blade set for a hair cutting appliance.

Further reference is made to FIG. 21, illustrating an associated method of manufacturing a blade set for a hair cutting appliance.

The method involves a step S50, relating to the provision of an inner sheet blank. In a subsequent step S52, a sheet metal component is formed, for instance by cutting. In a subsequent step S54, slots are processed in the sheet metal component that define a series of teeth. Further, a folding step S56 may follow wherein at least one folded edge in the sheet metal component is formed. Similarly, in a parallel sequence comprising steps S60, S62, S64, S66, an outer sheet is formed. In a step S60, an outer sheet blank is provided. In a subsequent step S62, a sheet metal component for the outer sheet is formed by cutting or stamping. In a further step S64, a series of slots is processed therein to define a series of teeth. Further in a step S66, the sheet metal component is folded.

The steps S52/S54 and S62/S64, respectively, may be performed simultaneously.

Both the inner sheet and the outer sheet are joined in a joining step S70. Eventually, the outer sheet is wrapped around the inner sheet.

Further, provision steps S72 and S74 are provided. In the step S72, a movable blade is provided. In the step S74, an intermediate guide element is provided. The movable blade and the intermediate guide element are arranged such that they have to be jointly inserted in a guide slot defined by the inner sheet and the outer sheet. Consequently, an assembly step S76 follows, wherein the inner sheet, the outer sheet, the movable blade and the intermediate guide element are joined and assembled.

Further, in a subsequent step S78, the inner sheet, the outer sheet and the intermediate guide element are fixedly attached to one another, for instance by bonding.

Figure 22:
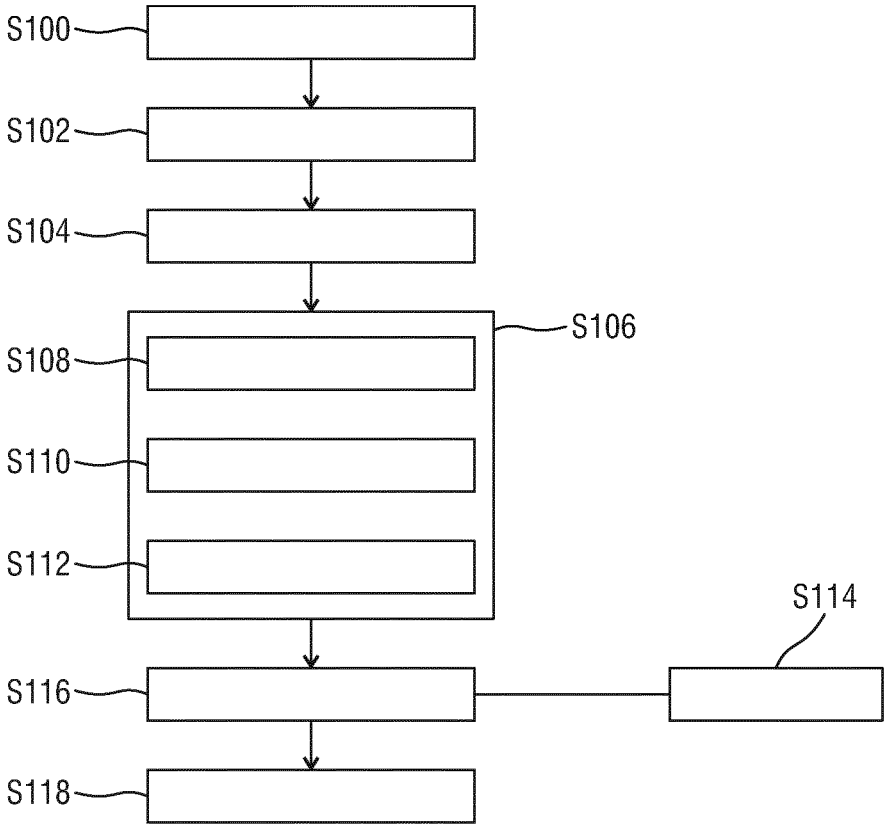
FIG. 22 is a block diagram of yet another embodiment of a method of manufacturing a blade set for a hair cutting appliance.

Reference is made to FIG. 22, illustrating an alternative embodiment of a method of manufacturing a blade set for a hair cutting appliance. The method involves a step S100 relating to the provision of a sheet metal blank. In a subsequent step S102, a sheet metal component is obtained from the blank, for instance by cutting or stamping. In a further step S104, a series of slots is processed in the sheet metal component to define a plurality of stationary blade teeth. The steps S100 and S102 may be performed simultaneously.

In a following folding step 106, three or more folding (sub-) steps S108, S110, S112 are performed. Hence, in accordance with the embodiment shown in FIG. 22, three folded edges are processed that are adjacent to one another to define a frontal end of the teeth of the stationary blade.

In some embodiments, the folding step S106 further involves the formation of folded edges in a central region of the stationary blade as therein an intermediate guide element or guide structure for a movable blade of the blade set may be formed.

In a step S114, a respective movable blade is provided. Hence, in an assembly step S116, the movable blade and the stationary blade may be joined and assembled. This may involve that the intermediate guide portion of the stationary blade engages a guiding recess at the movable blade to retain the movable blade in a guide slot of the stationary blade in an undetachable manner.

A further step S118 may follow wherein a top wall and a bottom wall of the stationary blade that are formed as a result of the folding step S106 are attached to one another, for instance by bonding. Bonding may involve soldering, welding, laser welding, clinching, etc.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A stationary blade for a blade set of a hair cutting appliance, the stationary blade comprising:

a top wall, a bottom wall, and a guide slot formed between the top wall and the bottom wall to accommodate a movable blade; and a plurality of stationary blade teeth extending from the top wall and the bottom wall, each tooth of the plurality of stationary blade teeth having a frontal end, wherein the top wall and the bottom wall are mutually joined at the frontal ends, wherein the top wall and the bottom wall are, at least at the frontal ends, made from sheet metal material, and wherein, at the frontal ends, two or more sheet metal folded edges are present including first sheet metal folded edges of the top wall forming a first gap below the top wall between the first sheet metal folded edges of the top wall, and second sheet metal folded edges of the bottom wall forming the guide slot above the bottom wall between the second sheet metal folded edges of the bottom wall.

2. The stationary blade as claimed in claim 1, wherein a rear portion of the frontal ends comprises four layers formed by sheet metal material, the rear portion being adjacent to the guide slot.

3. The stationary blade as claimed in claim 1, comprising an inner sheet and an outer sheet, wherein the outer sheet defines the top wall and the bottom wall, and wherein the inner sheet is arranged inside the outer sheet.

4. The stationary blade as claimed in claim 3, wherein the outer sheet is wrapped around the inner sheet.

5. The stationary blade as claimed in claim 3, wherein the inner sheet comprises an inner sheet folded edge at the frontal ends, wherein the outer sheet comprises an outer sheet folded edge at the frontal ends, and wherein the inner sheet folded edge is nestled in the outer sheet folded edge.

6. The stationary blade as claimed in claim 5, wherein the outer sheet comprises, adjacent to the outer sheet folded edge, a top layer and a bottom layer that are spaced away from one another by the inner sheet.

7. A stationary blade for a blade set of a hair cutting appliance, the stationary blade comprising:

an outer sheet having a top wall, an inner sheet having a bottom wall, and a guide slot formed between the top wall and the bottom wall to accommodate a movable blade, wherein the inner sheet is arranged inside the outer sheet; and a plurality of stationary blade teeth extending from the top wall and the bottom wall, each tooth of the plurality of stationary blade teeth having a frontal end, wherein the top wall and the bottom wall are mutually joined at the frontal ends, wherein the top wall and the bottom wall are, at least at the frontal ends, made from sheet metal material, wherein the inner sheet comprises an inner sheet folded edge at the frontal ends, and wherein the inner sheet comprises, adjacent to the inner sheet folded edge, a top layer and a bottom layer that contact one another.

8. The stationary blade as claimed in claim 7, wherein the top layer of the inner sheet defines a frontal end of the guide slot.

9. A stationary blade for a blade set of a hair cutting appliance, the stationary blade comprising:

an outer sheet having a top wall, an inner sheet having a bottom wall, and a guide slot formed between the top wall and the bottom wall to accommodate a movable blade, wherein the inner sheet is arranged inside the outer sheet; and a plurality of stationary blade teeth extending from the top wall and the bottom wall, each tooth of the plurality of stationary blade teeth having a frontal end, wherein the top wall and the bottom wall are mutually joined at the frontal ends, wherein the top wall and the bottom wall are, at least at the frontal ends, made from sheet metal material, wherein the inner sheet comprises an inner sheet folded edge at the frontal ends, wherein the plurality of stationary blade teeth comprises a first series of teeth at a first leading edge and a second series of teeth at a second leading edge, wherein the inner sheet connects the first leading edge and the second leading edge at the bottom wall, and wherein the outer sheet connects the first leading edge and the second leading edge at the top wall.

10. A blade set for a hair cutting appliance, the blade set comprising:

a stationary blade, and a movable blade comprising a plurality of movable blade teeth, wherein the stationary blade includes a top wall, a bottom wall, and a guide slot formed between the top wall and the bottom wall to accommodate a movable blade; and a plurality of stationary blade teeth extending from the top wall and the bottom wall, each tooth of the plurality of stationary blade teeth having a frontal end, wherein the top wall and the bottom wall are mutually joined at the frontal ends, wherein the top wall and the bottom wall are, at least at the frontal ends, made from sheet metal material, wherein, at the frontal ends, two or more sheet metal folded edges are present including first sheet metal folded edges of the top wall forming a first gap below the top wall between the first sheet metal folded edges of the top wall, and second sheet metal folded edges of the bottom wall forming the guide slot above the bottom wall between the second sheet metal folded edges of the bottom wall, wherein in the guide slot of the stationary blade, an intermediate guide element is arranged between the top wall and the bottom wall, wherein in the movable blade, a guide recess is formed, wherein the intermediate guide element extends in the guide slot in such a way that the movable blade is movably retained, and wherein the movable blade is arranged to be moved with respect to the stationary blade to cut hair.

11. The blade set of claim 10, wherein a rear portion of the frontal ends comprises four layers formed by sheet metal material, the rear portion being adjacent to the guide slot.

12. The blade set of claim 10, comprising an inner sheet and an outer sheet, wherein the outer sheet defines the top wall and the bottom wall, and wherein the inner sheet is arranged inside the outer sheet.

13. The blade set of claim 12, wherein the outer sheet is wrapped around the inner sheet.

14. The blade set of claim 12, wherein the inner sheet comprises an inner sheet folded edge at the frontal ends, wherein the outer sheet comprises an outer sheet folded edge at the frontal ends, and wherein the inner sheet folded edge is nestled in the outer sheet folded edge.

15. The blade set of claim 14, wherein the inner sheet comprises, adjacent to the inner sheet folded edge, a top layer and a bottom layer that contact one another.

16. A method of manufacturing a sheet metal based stationary blade of a blade set for a hair cutting appliance, the method comprising acts of:

providing a sheet metal blank;

forming a flat sheet metal component;

forming at least one pattern of slots in the sheet metal component, thereby defining at least one toothed leading edge; and multiply folding the sheet metal component, thereby forming:

a top wall, a bottom wall, and a guide slot formed between the top wall and the bottom wall to accommodate a movable blade, and a plurality of stationary blade teeth extending from the top wall and the bottom wall, each tooth of the plurality of stationary blade teeth having a frontal end, wherein the top wall and the bottom wall are mutually joined at the frontal ends, and wherein, at the frontal ends, two or more sheet metal folded edges are formed including first sheet metal folded edges of the top wall forming a first gap below the top wall between the first sheet metal folded edges of the top wall, and second sheet metal folded edges of the bottom wall forming the guide slot above the bottom wall between the second sheet metal folded edges of the bottom wall.

* * * * *